United States Patent [19]

Ho

[11] Patent Number: 4,847,736

[45] Date of Patent: Jul. 11, 1989

[54] ILLUMINATED WALL VASE HAVING REMOVABLE FACES

[76] Inventor: Tze H. Ho, 3101 Montezuma Ave., Alhambra, Calif. 91803

[21] Appl. No.: 233,147

[22] Filed: Aug. 17, 1988

[51] Int. Cl.[4] ..... F21P 3/00

[52] U.S. Cl. ..... 362/122; 362/147; 362/293; 362/806; 47/41 R; 248/27.8

[58] Field of Search ..... 362/101, 122, 147, 154, 362/293, 432, 806; 47/41 R; 248/27.8

[56] References Cited

U.S. PATENT DOCUMENTS

| | | | |
|---|---|---|---|
| 1,096,992 | 5/1914 | Bloom | 215/100 R |
| 1,321,337 | 11/1919 | Ronayne | 362/122 |
| 1,758,130 | 5/1930 | Shoemaker | 362/806 |
| 2,723,341 | 11/1955 | Greenspan | 362/122 X |
| 3,536,908 | 10/1970 | Oster | 362/32 |
| 3,634,678 | 1/1972 | Glass et al. | 362/32 |
| 3,662,381 | 5/1972 | Steffens | 340/378 |
| 3,939,338 | 2/1976 | Giammalvo | 362/122 |
| 4,060,722 | 11/1977 | Foley | 362/32 |

*Primary Examiner*—Stephen F. Husar

*Attorney, Agent, or Firm*—Roberts and Quiogue

[57] ABSTRACT

A vase including a wall mountable frame and a removable, semi-translucent vase face which together form an enclosure having a top opening. A light source and color changing mechanism enclosed within the enclosure provide light of varying color which is transmitted by the vase face and by a removable, light transmitting, stem holding container located within the top opening of the enclosure formed by the frame and the removable vase face.

12 Claims, 3 Drawing Sheets

ILLUMINATED WALL VASE HAVING REMOVABLE FACES

BACKGROUND OF THE INVENTION

The disclosed invention relates to a decorative display devices for holding stemmed decorative items such as flowers, and is more particularly directed to a wall vase having removable faces as well as removable holders for the stemmed decorative items.

The prior art includes display devices for fresh flowers, dried flowers, and simulated flowers.

U.S. Pat. No. 1,096,992, issued to Bloom, discloses an ornamental jar for exhibiting flowers and similar products. The flowers are held within the ornamental jar by a holder which is cylindrical or conical in shape and is held in place within the transparent jar by a plurality of support arms. The holder and the flowers or similar products are contained within the jar which is covered and contains a vacuum.

U.S. Pat. No. 3,536,908, issued to Oster, and U.S. Pat. No. 4,060,711, issued to Foley, disclose variable color light sources that utilize rotating color wheels and fiber-optic elements to transmit light to a plurality of light emitting decorative branches.

U.S. Pat. No. 3,634,678, issued to Glass et al., discloses a simulated flower arrangement set which includes a base having a light source at the bottom. The top portion of the base includes an apertured plate for receiving rod-like stems of the simulated flowers. The stems and terminating plastic petal components are translucent so that light from the light source in the base is transmitted upwardly through the translucent rod-like stems.

U.S. Pat. No. 3,939,338, issued to Giammalvo, discloses a combined terrarium and lamp, wherein the terrarium includes a bottom section having one or more incandescent lamps which are always lit for illuminating the terrarium from below.

U.S. Pat. No. 1,321,337, issued to Ronayne, discloses a vase that contains an incandescent lamp for illuminating artificial foliage and flowers held in the top portion of the vase by a supporting frame. The artificial flowers may further include small electric light bulbs.

U.S. Pat. No. 3,662,381, issued to Steffens, is directed to a lighting device that includes an upper portion of resinous transparent material in which small light bulbs and connecting wires are embedded. The upper resinous mass rests upon a base that houses incandescent lamps and circuitry for controlling the sequences and duration of operation of the different light bulbs.

The prior art devices are complex, bulky, and not easily changed to accommodate different faces, nor do they easily accommodate different sets of display flowers or the like.

SUMMARY OF THE INVENTION

It would therefore be an advantage to provide an improved decorative display device for holding stemmed decorative items.

Another advantage would be to provide an illuminated decorative display device for holding stemmed decorative items wherein the face of the display device can be readily changed.

It would be an advantage to provide a decorative display device for stemmed decorative items wherein the stemmed decorative items can be readily changed from one set to another.

A further advantage would be to provide an illuminated decorative display device for holding stemmed decorative items which is compact and easily wall mounted.

Yet another advantage would be to provide an illuminated decorative display device for stemmed decorative items wherein the stemmed decorative items can be real flowers, dried flowers, or simulated flowers.

The foregoing and other objects are achieved in an illuminated decorative display device which includes a frame adapted to be wall mounted, and a removable vase face secured thereto. The frame and the vase face form an enclosure, and a light source and a color changing mechanism enclosed therein provide light of varying color to a removable light transmitting container located within the top opening of the enclosure formed by the frame and the removable vase face.

BRIEF DESCRIPTION OF THE DRAWING

The advantages and features of the disclosed invention will readily be appreciated by persons skilled in the art from the following detailed description when read in conjunction with the drawing wherein.

DETAILED DESCRIPTION

Figure 1:
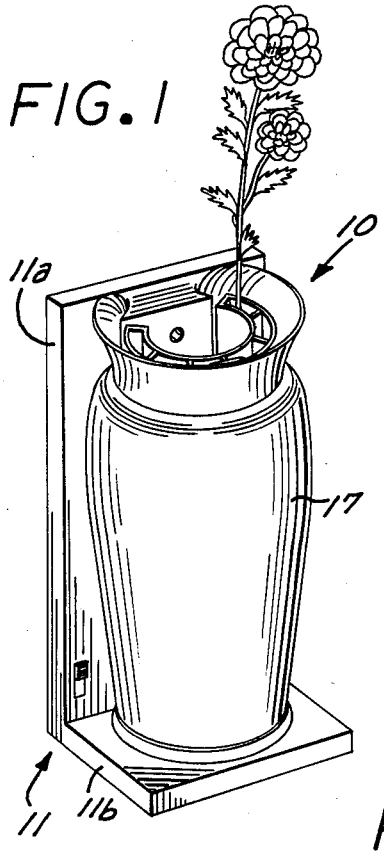
FIG. 1 is a perspective view of a wall mountable decorative vase in accordance with the invention.

In the following detailed description and in the several figures of the drawing, like elements are identified with like reference numerals.

Figure 8:
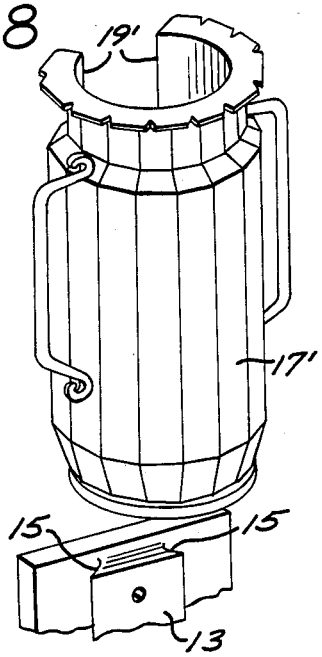
FIGS. 8–10 illustrate further examples of removable and replaceable vase faces that can be utilized with the disclosed vase.
Figure 9:
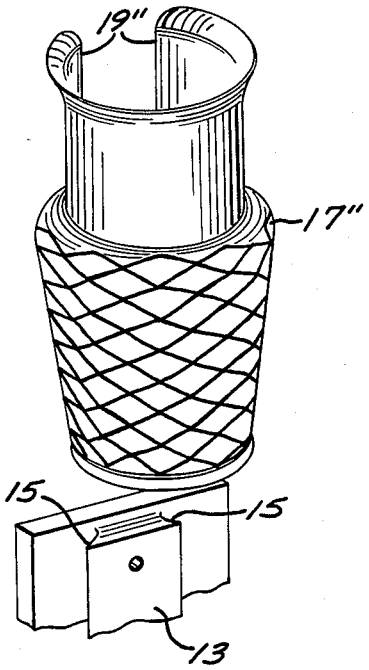
Figure 10:
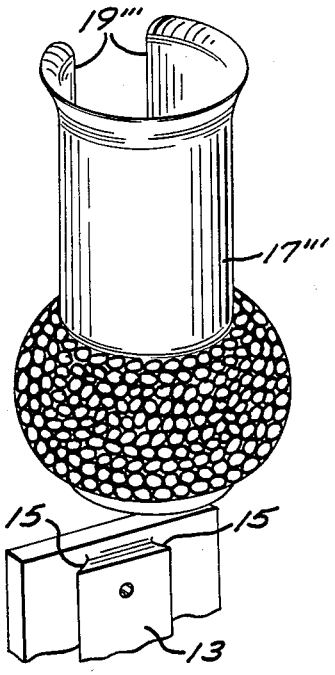

Referring now to the figures, a wall-mountable, illuminated, decorative vase 10 includes an L-shaped frame 11 which includes a vertical section 11a having a central, vertically extending, elongated raised portion 13. The sides of the raised portion 13 form outwardly facing grooves or slots 15 which are adapted to slidably interlock with a removable and replaceable vase face 17, a particular example of which is shown in FIGS. 1–4 and 7. FIGS. 8–10 respectively illustrate further examples of removable and replaceable vase faces 17', 17'' and 17''' that can be utilized with the disclosed vase.

Figure 7:
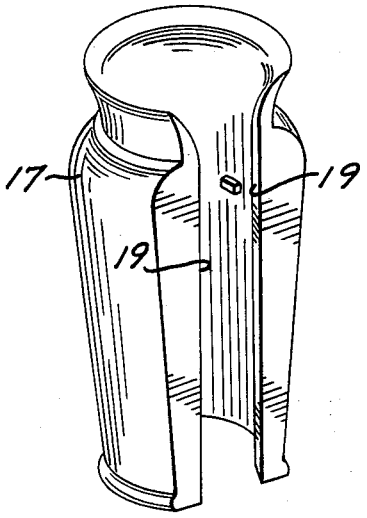
FIG. 7 is a rear perspective view of the example shown in FIGS. 1–4 of a removable and replaceable vase face that can be utilized with the disclosed vase.

The vase face 17 is generally shaped like a vase, except that its rear portion is truncated along a vertical plane as particularly illustrated in FIG. 7. The rear portion of the vase face 17 includes vertically elongated, inwardly extending projections 19, which are adapted to slidably engage the slots 15. Specifically, the vase face 17 is secured to the frame 11 by engaging the bottom portion of the vertically elongated projections 19 with the top portion of the slots 15 and then sliding the vase face 17 downwardly relative to the frame 11. The vase face is removed by sliding the vase face 17 upwardly relative to the frame 11 to disengage the vertically elongated projections 19 of the vase face from the slots 15 of the frame 11.

The horizontal frame section 11*b* includes a raised platform 18 that is located adjacent the raised portion 13 of the vertical frame section 11*a*, and is laterally centrally located. The raised platform 18 is configured to be enclosed by the bottom portion of the vase face 17. A lamp socket 21 is mounted in the raised platform 18 of the horizontal frame section 11*b* for accepting a lamp 23. A reflector 25 is secured to either the lamp socket 21 or the raised platform 18 directs light upwardly.

Above the lamp 23, a plurality of light transmitting colored vanes 27 are commonly secured to a shaft 29 which is rotated by a miniature electric motor 31 mounted in the vertical frame portion 11*a*. As shown, colored vanes 27 are secured to the shaft 29 so that the respective planes formed by the vanes 27 intersect along the centerline of the shaft 29. A switch 33 provides on/off control for the motor 31. Alternatively, the switch 33 could control both the motor 31 and the lamp 23. As still another alternative, a three-position switch could be used to have both the motor and lamp on or off, and also to have only the lamp on.

The vase face 17 is adapted to enclose the vanes 27, the lamp 23, the reflector 25, and the raised platform 18. A top opening is formed by the frame 11 and the vase face 17.

By way of example, the L-shaped frame 11 can be made of plastic while the vase face 17 is preferably made of a colored, semi-translucent plastic.

Figure 2:
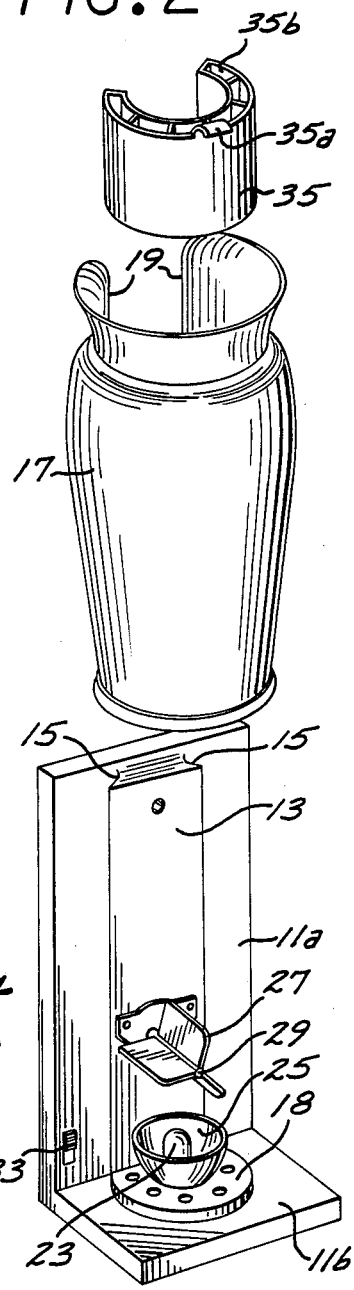
FIG. 2 is an exploded perspective view of the vase of FIG. 1 illustrating the removability of an example of a removable and replaceable vase face.
Figure 3:
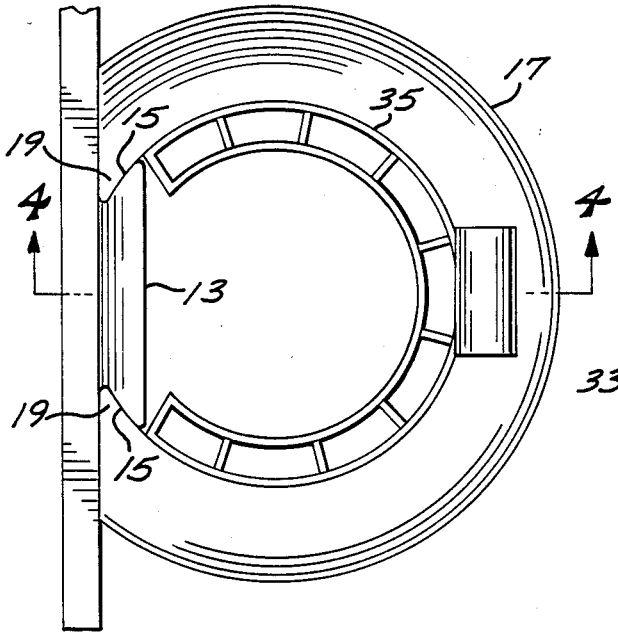
FIG. 3 is a top plan view of the vase of FIG. 1.
Figure 4:
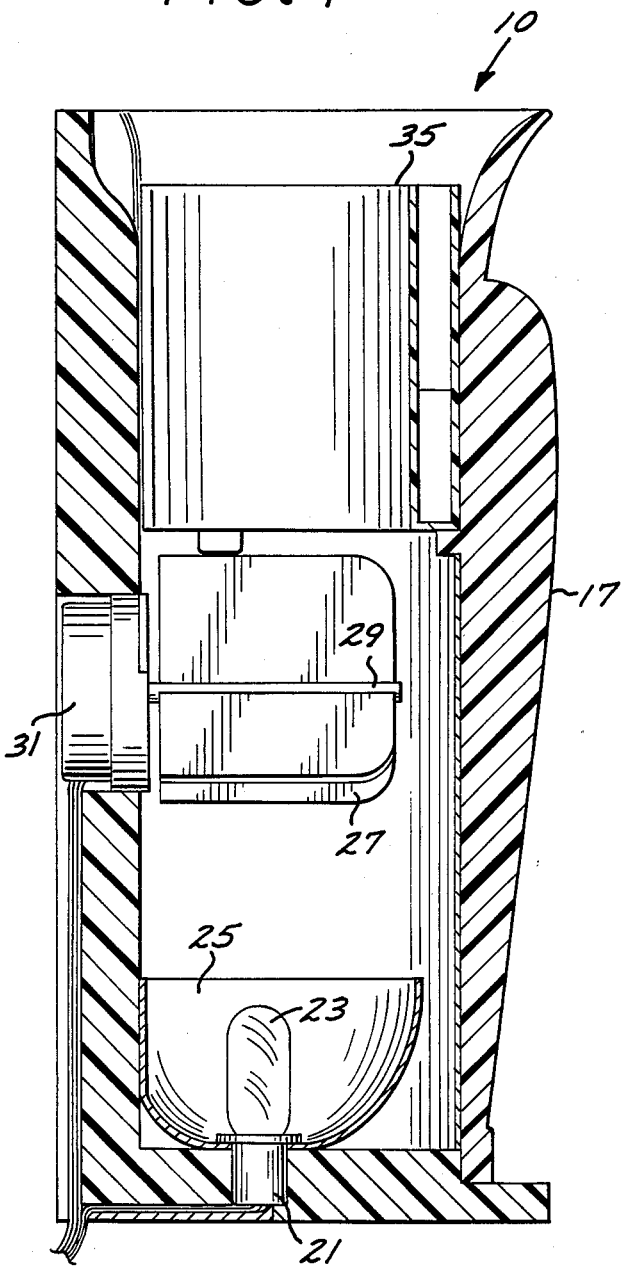
FIG. 4 is sectional view of the vase of FIG. 1 taken along the section line 4 shown in FIG. 3.
Figure 5:
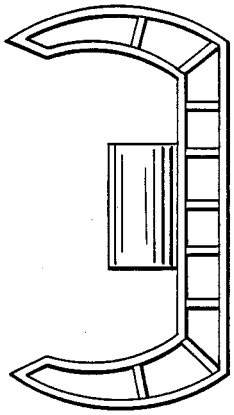
FIGS. 5 and 6 are top plan views of other configurations for a removable stem holder of the vase of FIG. 1.
Figure 6:
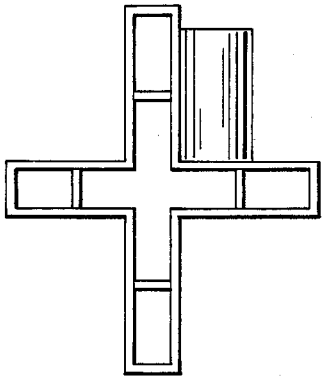

Referring specifically to FIG. 2, a stem holder 35 is configured to be selectively placed in the top opening formed by the frame 11 end the vase face 17. The container 35 is preferably transparent or translucent, for example, of a plastic material, and includes a finger tab 35*a* for installing or removing the container 35 in the top opening formed by the vertical frame section 11*a* and the vase face 17. The container 35 includes compartments 35*b* having water tight sides and bottoms for individually supporting the stems of decorative stemmed items such as fresh or artificial flowers. FIGS. 5 and 6 illustrate other stem holder configurations.

In operation, with the lamp 23 on, the rotation of the colored vanes 27 provides illumination that is continually varying in color. The illumination transmitted through the container 35 illuminates the stemmed decorative items therein, and produces varying color and shadow illumination on the part of the wall adjacent the top of the wall vase 10 and on the ceiling above the wall vase. Further, the vase face 17 transmits light of varying colors. The totality of changing colors and shadow images provide pleasing visual effects.

The wall mounted vase 10 further provides for an unusual pleasing appearance by including only a portion of a traditional vase, thereby creating the illusion that the remainder of the vase is in the wall on which the vase 10 is mounted.

The removable and replaceable vase face 17 allows for the use of vase faces of different styles and colors, which can be changed as desired. As a result of the securing structures on the frame 11 and the vase face 17, no tools or additional hardware such as screws or nails are necessary.

The removable container 35 allows for simple replacement of the stemmed decorative items, and also allows for easy filling with, or disposal of, water for fresh flowers without removing the vase for the wall. This reduces work, maintenance time, and also reduces the chance of breakage. Also, the availability of different container configurations facilitates different arrangements of the stemmed decorative items.

The capability of mounting the vase 10 on a wall avoids the use of table space, decorates the wall on which it is mounted, and provides functional as well as decorative illumination.

Although the foregoing has been a description and illustration of specific embodiments of the invention, various modifications and changes thereto can be made by persons skilled in the art without departing from the scope and spirt of the invention as defined by the following claims.

What is claimed is:

1. A vase comprising:

a frame adapted to be mounted on a wall;

a removable vase face secured to said frame, said removable face and said frame forming an enclosure having an opening at the top portion thereof;

means for securing said vase face to said frame; and a removable container located within said opening for supporting stemmed decorative items.

2. The vase of claim 1 wherein said means for securing comprises elongated interlocking channels formed on said frame and said removable vase face.

3. The vase of claim 1 wherein said light removable container is adapted to contain water.

4. An illuminated decorative display device comprising:

a vase shaped housing having a top portion with a recess and being adapted for wall mounting:

a removable light transmitting container for receiving stemmed decorative items, said removable light transmitting container being engaged in the recess of said housing; and lighting means contained within said vase shaped housing for variably illuminating said removable light transmitting container with light of different colors;

whereby said wall is illuminated with colorful, changing light.

5. The illuminated decorative display device of claim 4 wherein said lighting means comprises a light source, and means for varying the color of the light transmitted from said light source to said removable light transmitting container.

6. The illuminated decorative display device of claim 5 wherein said color varying means includes a plurality of colored light transmitting vanes interposed between said light source and said removable light transmitting container.

7. The illuminated decorative display device of claim 1 wherein said light transmitting vanes are mounted on a rotatable shaft, with the planes formed by said vanes intersecting along the centerline of said shaft.

8. A vase comprising:

a frame adapted to be mounted on a wall;

a removable vase face secured to said frame, said removable face and said frame forming an enclosure having an opening at the top portion thereof;

means for securing said vase face to said frame;

a removable light transmitting container located within said opening for supporting stemmed decorative items;

a light source located within said enclosure for directing light through said light transmitting container; and color changing means interposed between said light source and said light transmitting container for varying the color of the light provided to said container;

whereby said wall is illuminated with colorful, changing light.

9. The vase of claim 8 wherein said means for securing comprises elongated interlocking channels formed on said frame and said removable vase face.

10. The vase of claim 8 wherein said light transmitting container is adapted to contain water.

11. The vase of claim 8 wherein said color changing means includes a miniature electric motor and a plurality of colored light transmitting elements.

12. The vase of claim 8 wherein said removable vase face is semi-translucent.

* * * * *